US008978926B2

(12) United States Patent
Leshay

(10) Patent No.: US 8,978,926 B2
(45) Date of Patent: Mar. 17, 2015

(54) FLOWER VENDING MACHINE AND METHOD OF USE OF THE SAME

(71) Applicant: Wakka Holding, LLC, Miami, FL (US)

(72) Inventor: Michael Alan Leshay, Madrid (ES)

(73) Assignee: Wakka Holdings, LLC, Miami, FL (US)

( * ) Notice: Subject to any disclaimer, the term of this patent is extended or adjusted under 35 U.S.C. 154(b) by 165 days.

(21) Appl. No.: 13/705,880

(22) Filed: Dec. 5, 2012

(65) Prior Publication Data

US 2014/0124523 A1 May 8, 2014

(30) Foreign Application Priority Data

Nov. 7, 2012 (ES) ..... 201231704

(51) Int. Cl.
*G07F 9/10* (2006.01)
*G07F 11/54* (2006.01)
*A47F 7/00* (2006.01)

(52) U.S. Cl.
CPC ..... *G07F 9/105* (2013.01); *G07F 11/54* (2013.01); *A47F 7/0078* (2013.01)
USPC ..... 221/150 R

(58) Field of Classification Search
CPC ..... G07F 17/0042; G07F 9/105; G07F 11/54; A47F 7/0078
USPC ..... 221/150 R, 150 HC, 150 A
See application file for complete search history.

(56) References Cited

U.S. PATENT DOCUMENTS 7,086,198 B2 * 8/2006 Hayden ..... 221/150 R
7,447,563 B2 * 11/2008 Dobos ..... 700/231
8,145,351 B2 * 3/2012 Schininger et al. ..... 700/237

FOREIGN PATENT DOCUMENTS

WO 2010055518 A1 5/2010

* cited by examiner

*Primary Examiner* — Timothy Waggoner

(57) ABSTRACT

Flower vending machine and method of use of the same, with the object of preventing fogging of a display space comprised within said machine, said display space being accessible by means of at least one hatch covered by a transparent sheet to which is directed a flow of air to preventing fogging of the interior of the display space. In the method of use of said machine the cooling system is stopped, the flow of air is introduced and an air extractor external to the display space is activated. All this prevents the fogging of the display space, thereby guaranteeing excellent visibility of the flowers as well as their optimum preservation.

8 Claims, 3 Drawing Sheets

FLOWER VENDING MACHINE AND METHOD OF USE OF THE SAME

OBJECT OF THE INVENTION

The present invention relates to a flower vending machine which comprises a display space accessible by means of at least one hatch covered by a transparent sheet to which is directed a flow of air which creates a protective shield to prevent the ingress of external air, and hence fogging of the interior of the display space.

The invention also relates to the method of using said machine, into which the air flow is introduced to cool the machine and an air extractor outside the display space is activated.

The object of said machine and its method is to prevent fogging of the inside of the interior of the display space, thereby guaranteeing excellent visibility of the flowers, as well as their optimum preservation.

BACKGROUND TO THE INVENTION

Vending machines are known for multiple articles, such as flowers. These machines are designed to be installed in waiting areas or passageways, such as bus, metro, railway stations, airports, hospitals, etc.

For example, the patent with publication number WO2010/055518 discloses a flower vending machine with a fixed rotary shaft on which are arranged water containers provided with an opening through which are inserted the shanks. Since this opening is of relatively short size relative to the area of the water containers, the possibility of fogging is reduced due to the evaporation of the water, compared to machines in which said containers are open and the water is visible to the consumer.

The patent with publication U.S. Pat. No. 7,086,198 discloses a flower vending machine with stacked modules of circular cross-section in which are arranged turntables which accommodate the products. On each module windows are arranged to enable said products to be removed. On each side of the rectangular windows are arranged lights enabling the displayed products to be seen and also serve to reduce the fogging by means of the heat generated.

The inventions or prior art do not prevent the inconvenient fogging of the interior of the machines, specifically of the display areas, which prevent the products for sale from being clearly seen, causing the denial of a possible purchase by a user.

Likewise, these inventions do not prevent the harmful moist air from entering the display or storage space either, which reduces the life of the products to be sold, nor do they prevent possible moisture that would affect the electrical and electronic components.

To overcome the disadvantages mentioned the following invention is proposed of a flower vending machine and its method of use.

DESCRIPTION OF THE INVENTION

The present invention is established and characterised in the independent claims, whilst the dependent claims describe other features of the same.

In the light of the above, the present invention relates to a flower vending machine. The machine comprises a casing with an outer shield, creating in its interior a display space and a space for the machinery.

In the machine space is arranged a cooling system which provides ventilation for conditioning the air in the display space. In said display space is arranged a vertical rotary shaft to which are fixed trays of different heights.

At the front of at least one tray is arranged a hatch made in the casing, covered with a transparent sheet.

On the upper side of the hatch is fixed a distributor which comprises a base for securing to said upper side of the hatch, and a lip which is connected to said base pointing in the downward direction.

An air pipe is fed from the cooling system to the distributor so that the lip directs the air flow provided via said pipe to the transparent sheet which covers the hatch. This creates a protective shield in the form of a layer of air which, in the manner of a curtain or wall, prevents the ingress of air from the outside, thereby preventing fogging of the interior of the display space.

The method of use of the flower vending machine previously described comprises the following steps:

a. stopping the cooling system, b. introduction of air via the pipe to the distributor, c. starting an air extractor outside the display space.

DESCRIPTION OF THE FIGURES

The present specification is supplemented by a set of figures that are non-exhaustive and illustrate the preferred embodiment of the invention.

DETAILED EXPLANATION OF THE INVENTION

As described above, the present invention relates to a flower vending machine.

Figure 1:
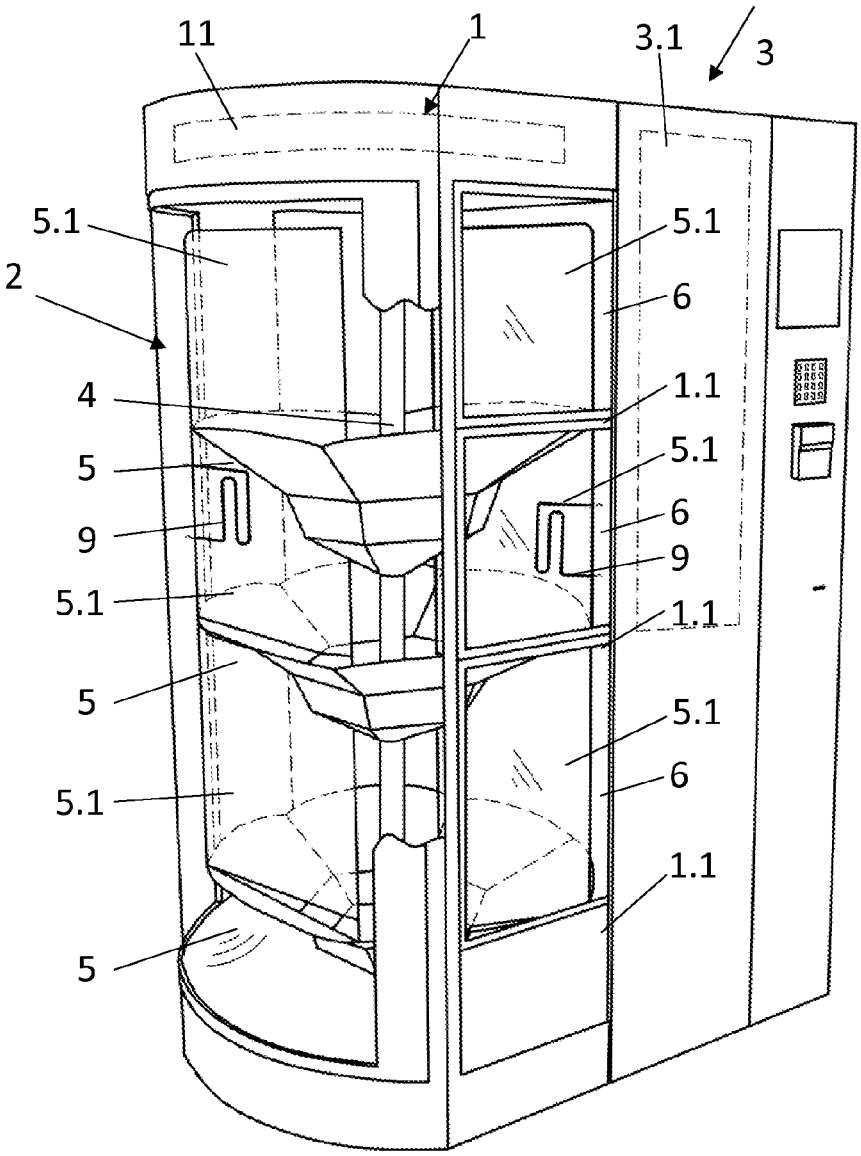
FIG. 1 shows a perspective view of the flower vending machine with a partial section of the casing to view the vertical rotary shaft.

As shown in FIG. 1, the machine comprises a casing (1) in the manner of an outer shield, thereby creating in its interior a display space (2), in which are displayed the products that are sold, and a machinery space (3) where all the elements required for the operation of the machine are installed.

In the display space (2) is arranged a vertical rotary shaft (4) to which are fixed plates (5) at different heights.

At the front of at least one of said plates (5) is arranged a hatch (1.1) in the manner of an opening made in the casing (1), covered by a transparent sheet (6), for example of transparent glass or plastic. This hatch (1.1) is moved, after payment is made, to provide access for collection of the flowers.

Hatch (1.1) comprises an upper side (1.2) in which is fixed a distributor (7). The sides of hatch (1.1) may be considered the frame, which forms part of the casing (1), which surrounds said hatch (1.1); hence an upper side (1.2) is the upper side of said frame.

Figure 2:
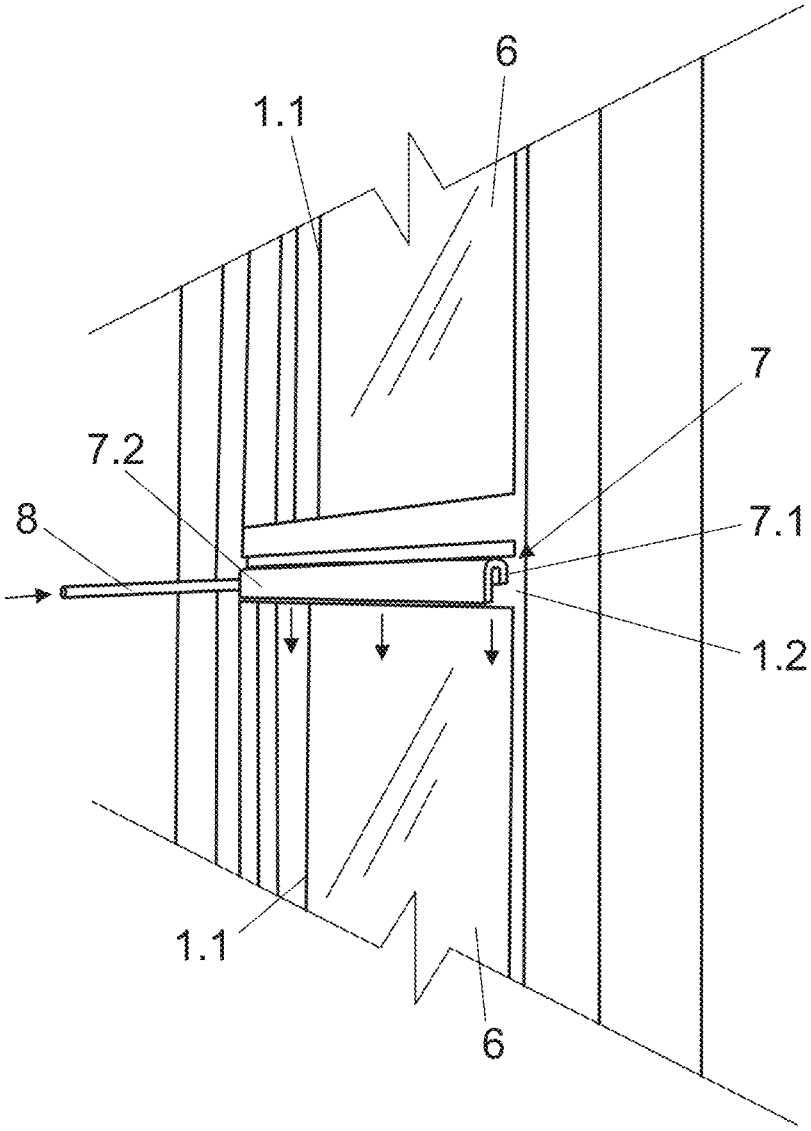
FIG. 2 shows a perspective view of a detail from the interior of the display space of the machine in FIG. 1, in which can be seen the arrangement of the distributor relative to the hatch.

As shown in FIG. 2, distributor (7) comprises a base (7.1) for its fixing to said upper side (1.2) of hatch (1.1), and a lip (7.2).

Lip (7.2) is connected to base (7.1), it points downwards and a pipe (8) is fed to it carrying air deriving from a cooling system (3.1).

Said lip (7.2) therefore directs the air flow supplied via said pipe (8) to the transparent sheet (6) to create a protective shield and prevent fogging in the interior of display space (2) which is produced when hatch (1.1) is opened and air enters from the outside of the machine.

As already mentioned, cooling system (3.1) is in turn arranged in machinery space (3), together with means for actuating both vertical shaft (4) and for opening hatch (1.1) at the time the flowers are dispensed. Similarly, machine space (3) accommodates other known components (not shown in the figures), such as means of selection and payment ordered by an electronic system, means of communication by cable or wireless, screens for communication with the user, etc.

Arranged preferably in the upper area of display space (2) and external to it, casing (1) comprises an extractor (11), which is in liquid communication with cooling system (3.1). The function of this extractor (11) is to eliminate the condensation from moisture produced on the outside of the display space, specifically, and as shown in the embodiment of the figures, in the external upper area of casing (1), so that the electronic elements located in that area are prevented from being affected by any moisture.

As can be se seen in FIG. 1, a vertical panel (5.1) parallel with vertical shaft (4) and vertical (5.1) is arranged preferably fixed to plate (5), and a heating coil (9) is fixed to said vertical panel (5.1) to prevent fogging of said panel (5.1) and interact with it to prevent fogging of the interior of display space (2). Specifically, two vertical panels (5.1) fixed diametrically opposite each other by each plate (5), are shown in FIG. 1, and heating coil (9) consists of three straight and two curved segments which connect them, representing the ends of conductor cable which are connected to a supply source, thereby expressing diagrammatically the electrical connection of heating coil (9).

Optionally plate (5) may also comprise various constituent sections (5.2). Each of sections (5.2) comprises in turn a support surface (5.3), normally horizontal, or with a certain slope, on which are arranged the flowers, with a front side (5.31) which is connected to vertical shaft (4), and a rear side (5.32) on which is connected, in the upward direction, a first sloped surface (5.4).

Figure 3:
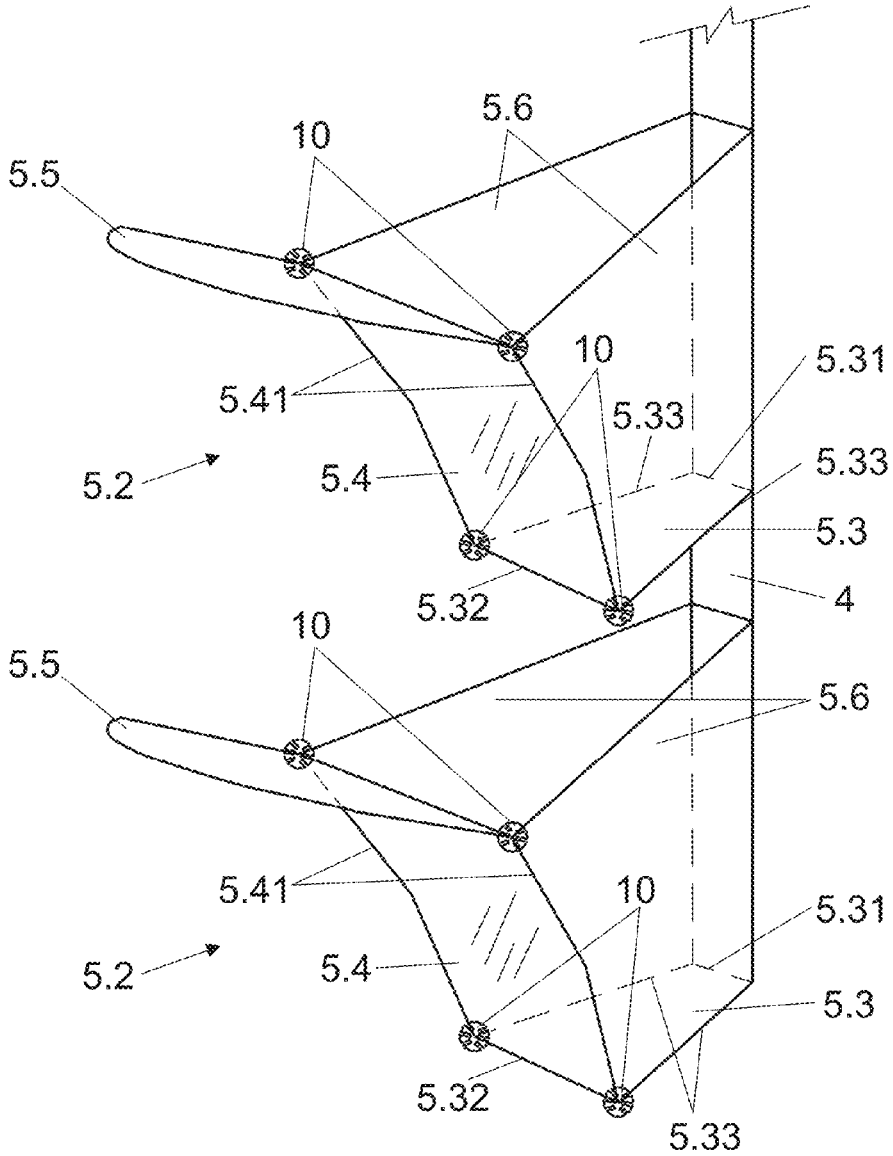
FIG. 3 shows a perspective view of the sections that comprise the plates of the machine in FIG. 1.

As shown in the embodiment in FIG. 3, a second sloped surface (5.5), of greater slope than the first relative to support surface (5.3), is connected to the first sloped surface (5.4). Moreover, a lateral surface (5.6) is fixed to a lateral side (5.33) of support surface (5.3) and to a lateral side (5.41) of the first sloped surface (5.4). It is possible to have two lateral surfaces (5.6) for each section (5.2), as shown, thereby providing each section (5.2) with greater rigidity, said lateral surfaces (5.6) of two adjacent sections (5.2) being used as fixing surfaces between them.

This configuration of sections (5.2) with the aforementioned surfaces is compatible with the object of the invention since it directs in an efficient manner the air circulating through display space (2) and through plates (5). This circulation is important because it must not be forgotten that the products, flowers, consist of branches which ultimately become multi-branch structures which bifurcate uncontrollably the air circulating around it. The aforementioned surfaces therefore interact to control the circulating air and, moreover, said control is optimised by using controllable connections between the aforementioned surfaces, whilst the connection between the support surface (5.3) and the first sloped surface (5.4) and/or between the first sloped surface (5.4) and the second sloped surface (5.5) is obtained by means of slope controllers (10) in order to regulate the relative slope between the parts in which they are arranged.

In the embodiment shown in FIG. 3, the slope controllers (10) are multi-grooved parts so that each groove accommodates one edge of the surfaces and enables the relative slope to be selected between the two surfaces on which each slope controller (10) is installed.

Moreover, as an added advantage derived from the aforesaid slope, the first sloped surfaces (5.4) may have a mirror finish so that the branches located on the plates (5) exhibit a reflection directed towards the user of the rear part of the branch, therefore providing a more complete view of said branch.

The method of use of the flower vending machine previously described comprises the following steps:

a. stopping of the cooling system (3.1) so that the introduction of air to display space (2) is stopped;

b. introduction of air via pipe (8) to distributor (7), creating a curtain stopping air deriving from the exterior of the machine when hatch (1.1) is opened;

c. starting of extractor (11) outside the display space to absorb the moist air in the external upper area of casing (1).

This makes it possible to prevent the ingress of moisture inside display space (2), thus preventing fogging due to condensation of the air and providing excellent visibility of the flowers from the outside of the machine, as well as optimum preservation of the same.

The invention claimed is:

1. A flower vending machine comprising a casing, with an outer shield, thereby creating in its interior a display space and a machinery space, wherein in said machinery space is arranged a cooling system and in the display space is arranged a rotary vertical shaft to which are fixed plates at different heights, so that at the front of at least one plate is arranged a hatch made in the casing, said hatch covered with a transparent sheet, wherein the hatch comprises an upper side, in which is fixed a distributor, which comprises a base for its fixing to said upper side, and a lip connected to said base and directed downwards, to which lip is fed a pipe carrying air from the cooling system, so that said lip directs the flow of air supplied via said pipe to the transparent sheet, thereby creating a protective shield for preventing the ingress of air and the consequent fogging of the interior of the display space.

2. The flower vending machine according to claim 1, wherein, fixed to the plate, is arranged a vertical panel parallel with the vertical shaft, and where a heating coil is fixed to said vertical panel to prevent fogging of said vertical panel.

3. The flower vending machine according to claim 1, wherein the plate comprises various sections, each of which comprises a support surface with a front side which is connected to the vertical shaft, and a rear side on which is connected, in the upward direction, a first sloped surface.

4. The flower vending machine according to claim 3, further comprising a second sloped surface of greater slope than the first sloped surface relative to the support surface, is connected to the first sloped surface.

5. The flower vending machine according to claim 3 or 4, wherein the support surface and the first sloped surface and/or between the first sloped surface and the second sloped surface are connected by means of slope controllers so that they enable the relative slope between the parts in which they are arranged to be controlled.

6. The flower vending machine according to claim 3 or 4, wherein a lateral surface is fixed to a lateral side of the support surface, and to a lateral side of the first sloped surface.

7. The flower vending machine according to claim 1, wherein the casing comprises an extractor external to the display space.

8. A method of use of a flower vending machine according to claim 7, comprising the following steps:

a. stopping of the cooling system,
b. introduction of air through the pipe to the distributor,
c. starting of the extractor external to the display space.

* * * * *